US010816242B2

(12) United States Patent
Tanaka et al.

(10) Patent No.: US 10,816,242 B2
(45) Date of Patent: Oct. 27, 2020

(54) REFRIGERATION CYCLE APPARATUS

(71) Applicant: Mitsubishi Electric Corporation, Tokyo (JP)

(72) Inventors: Chitose Tanaka, Tokyo (JP); Takuya Matsuda, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 15 days.

(21) Appl. No.: 16/097,898

(22) PCT Filed: Jul. 29, 2016

(86) PCT No.: PCT/JP2016/072298
§ 371 (c)(1),
(2) Date: Oct. 31, 2018

(87) PCT Pub. No.: WO2018/020654
PCT Pub. Date: Feb. 1, 2018

(65) Prior Publication Data

US 2019/0145669 A1 May 16, 2019

(51) Int. Cl.
*F25B 6/02* (2006.01)
*F25B 30/00* (2006.01)
(Continued)

(52) U.S. Cl.
CPC ..... *F25B 6/02* (2013.01); *F25B 5/02* (2013.01); *F25B 13/00* (2013.01); *F25B 39/028* (2013.01);
(Continued)

(58) Field of Classification Search
CPC ..... F25B 30/00; F25B 30/02; F25B 41/046; F25B 2600/17; F25B 2600/111;
(Continued)

(56) References Cited

U.S. PATENT DOCUMENTS 5,101,640 A 4/1992 Fukushima et al.
7,493,775 B2 * 2/2009 Shimamoto ..... F24F 3/065 62/199
(Continued)

FOREIGN PATENT DOCUMENTS

JP S60-148753 U 10/1985
JP S61-116975 U 7/1986
(Continued)

OTHER PUBLICATIONS

Japanese Office Action dated Oct. 15, 2019 issued in corresponding JP patent application No. 2018-530296(and English translation).
(Continued)

*Primary Examiner* — Frantz F Jules
*Assistant Examiner* — Erik Mendoza-Wilkenfel
(74) *Attorney, Agent, or Firm* — Posz Law Group, PLC

(57) ABSTRACT

A refrigeration cycle apparatus includes a refrigerant circuit in which a compressor, a first heat exchanger, an expansion mechanism, and a second heat exchanger are connected by pipes. The first heat exchanger includes a first refrigerant passage and a second refrigerant passage that share a plurality of fins with each other and provided in parallel in the refrigerant circuit. The apparatus further includes a high-and-low-pressure switching mechanism which is located on an inlet side of the second refrigerant passage of the first heat exchanger in flowing of refrigerant in an operation in which the first heat exchanger functions as a condenser, and which performs switching between flow directions of the refrigerant. The apparatus further includes a refrigerant blocking mechanism located on an outlet side of the second refrigerant passage of the first heat exchanger in the flowing of the refrigerant in the operation, and which blocks the flowing of the refrigerant.

10 Claims, 4 Drawing Sheets

(51) Int. Cl.

| | |
|---|---|
| ***F24F 3/00*** | (2006.01) |
| ***F25B 13/00*** | (2006.01) |
| ***F25B 39/04*** | (2006.01) |
| ***F25B 39/02*** | (2006.01) |
| ***F25B 49/02*** | (2006.01) |
| ***F25B 5/02*** | (2006.01) |
| ***F25B 41/04*** | (2006.01) |
| *F25B 29/00* | (2006.01) |

(52) U.S. Cl.
CPC ..... *F25B 39/04* (2013.01); *F25B 41/043* (2013.01); *F25B 49/027* (2013.01); *F25B 29/003* (2013.01); *F25B 2313/0233* (2013.01); *F25B 2313/0253* (2013.01); *F25B 2313/02731* (2013.01); *F25B 2313/02741* (2013.01); *F25B 2313/02792* (2013.01); *F25B 2339/04* (2013.01)

(58) Field of Classification Search
CPC ..... F25B 6/02; F28D 1/0233; F28D 1/0246; F24F 3/001; F24F 2110/32
See application file for complete search history.

(56) References Cited

U.S. PATENT DOCUMENTS 8,051,668 B2 * 11/2011 Singh ..... F25B 49/027 62/126
2006/0288713 A1 * 12/2006 Knight ..... F24F 3/153 62/176.6
2013/0019622 A1 1/2013 Nakashima et al.
2013/0145785 A1 6/2013 Nobuhiro

FOREIGN PATENT DOCUMENTS

| | | | |
|---|---|---|---|
| JP | H02-208452 | A | 8/1990 |
| JP | H03-175242 | A | 7/1991 |
| JP | H05-010609 | A | 1/1993 |
| JP | H05-172429 | A | 7/1993 |
| JP | H10-038391 | A | 2/1998 |
| JP | 2000-274857 | A | 10/2000 |
| JP | 2004-170023 | A | 6/2004 |
| JP | 2005-049051 | A | 2/2005 |
| JP | 2013-024485 | A | 2/2013 |
| JP | 2013-029242 | A | 2/2013 |
| JP | 2013-076532 | A | 4/2013 |
| JP | 2013-122354 | A | 6/2013 |

OTHER PUBLICATIONS

International Search Report of the International Searching Authority dated Oct. 11, 2016 for the corresponding International application No. PCT/JP2016/072298 (and English translation).
Extended European Search Report dated Jul. 16, 2019 issued in corresponding EP patent application No. 16910557.4.
Office Action dated Apr. 2, 2020 issued in corresponding EP patent application No. 16910557.4.

* cited by examiner

REFRIGERATION CYCLE APPARATUS

CROSS REFERENCE TO RELATED APPLICATION

This application is a U.S. national stage application of PCT/JP2016/072298 filed on Jul. 29, 2016, the contents of which are incorporated herein by reference.

TECHNICAL FIELD

The present invention relates to a refrigeration cycle apparatus which can ensure a necessary condensing pressure and a necessary compression ratio for the operation of the apparatus in a refrigeration cycle even in a cooling operation.

BACKGROUND ART

In general, a typical refrigeration cycle apparatus used as, for example, an air-conditioning apparatus, includes a refrigerant circuit in which a compressor, a four-way valve, an outdoor heat exchanger, an expansion valve and an indoor heat exchanger are successively connected. In such a refrigeration cycle apparatus, during a cooling operation, high-temperature high-pressure refrigerant discharged from the compressor exchanges heat with outdoor air while flowing through the outdoor heat exchanger, and as a result the refrigerant is condensed and liquified. The condensed and liquified refrigerant is decompressed by the expansion valve. Then, the refrigerant exchanges heat with indoor air while flowing through the indoor heat exchanger, and as a result the refrigerant is evaporated and gasified.

In such a refrigeration cycle apparatus, if a specific control is not performed during a cooling operation under a condition that a dry-bulb temperature of outdoor air is lower than an evaporating temperature of refrigerant in the indoor heat exchanger (which will be hereinafter referred to as a low-outdoor-air cooling operation time), a condensing capacity of the outdoor heat exchanger is excessively large, and the condensing pressure is thus reduced. Consequently, it is impossible to ensure a minimum necessary condensing pressure and a minimum necessary compression ratio for the operation of the apparatus in a refrigeration cycle, especially the operation of the compressor.

In view of the above, in a proposed technique, the condensing capacity of an outdoor heat exchanger is reduced to obtain a necessary condensing pressure and a necessary compression ratio (see, for example, Patent Literature 1). According to Patent Literature 1, for example, a control for reducing the flow rate of air flowing through outdoor heat exchangers by reducing the rotation speed of fans for the outdoor heat exchangers and a control for reducing a heat-exchanger capacity by closing an outdoor heat exchanger or exchangers of the above outdoor heat exchangers are performed in accordance with lowering of outside air, to thereby obtain a necessary condensing pressure and a necessary compression ratio at the low-outdoor-air cooling operation time.

CITATION LIST

Patent Literature

Patent Literature 1: Japanese Unexamined Utility Model Registration Application Publication No. 61-116975

SUMMARY OF INVENTION

Technical Problem

However, the technique disclosed in Patent Literature 1 has the following problem. When the rotation speed of the fans for the outdoor heat exchangers is reduced, the dependence of the flow rate of air flowing through the outdoor heat exchangers on wind flowing in the outside increases, as a result of which the refrigeration cycle easily becomes unstable as the wind varies. Therefore, there is a limit to the control of the capacity of the outdoor heat exchangers, that is performed by reducing the rotation speed of the fans for the outdoor heat exchangers.

Furthermore, in the technique disclosed in Patent Literature 1, a control for closing an outdoor heat exchanger is performed by a shut-off valve and a check valve. However, there is also a limit to a closing function of each of the shut-off valve and the check valve. Therefore, refrigerant gradually leaks from the shut-off valve and the check valve into the outdoor heat exchanger, and condenses and stays in the outdoor heat exchanger. Inevitably, in the refrigeration cycle, the operation of the apparatus is performed with an insufficient amount of refrigerant, and the condensing pressure and the compression ratio are reduced.

The present invention has been made to overcome the above problems, and aims to provide a refrigeration cycle apparatus that can perform a heat-exchanger capacity control to ensure a necessary condensing pressure and a necessary compression ratio for the operation of the apparatus in a refrigeration cycle even at the low-outdoor-air-temperature cooling operation time.

Solution to Problem

A refrigeration cycle apparatus according to an embodiment of the present invention includes a refrigerant circuit in which a compressor, a first heat exchanger, an expansion mechanism and a second heat exchanger are connected by pipes. The first heat exchanger includes a first refrigerant passage and a second refrigerant passage that share a plurality of fins with each other. The first refrigerant passage and the second refrigerant passage are provided in parallel in the refrigerant circuit. The apparatus further includes a high-and-low-pressure switching mechanism which is located on an inlet side of the second refrigerant passage of the first heat exchanger in flowing of refrigerant in an operation in which the first heat exchanger functions as a condenser, and which performs switching between flow directions of the refrigerant. The apparatus further includes a refrigerant blocking mechanism which is located on an outlet side of the second refrigerant passage of the first heat exchanger in the flowing of the refrigerant in the operation, and which blocks the flowing of the refrigerant.

Advantageous Effects of Invention

Since the refrigeration cycle apparatus according to the embodiment of the present invention includes the high-and-low-pressure switching mechanism located on the inlet side of the second refrigerant passage of the first heat exchanger and the refrigerant blocking mechanism located on the outlet side of the second refrigerant passage of the first heat exchanger, in the flowing of the refrigerant in the operation in which the first heat exchanger functions as a condenser, it can performs a heat-exchanger capacity control to block the flowing of the refrigerant into the second refrigerant passage. Therefore, even in a cooling operation under a condition that a dry-bulb temperature of air for heat exchange in the first heat exchanger is lower than an evaporating temperature of refrigerant in the second heat exchanger, the refrigeration cycle apparatus according to the embodiment of the present invention can greatly reduce the amount of refrigerant condensing and staying in the first heat exchanger, thus ensuring a necessary condensing pressure and a necessary compression ratio for the operation of the apparatus in a refrigeration cycle.

DESCRIPTION OF EMBODIMENTS

A refrigeration cycle apparatus according to the present invention will be described with reference to the drawings.

It should be noted that the configurations, operations, etc. referred to in the following are mere examples, that is, the configuration, operations, etc. of the refrigerant cycle apparatus are not limited to the configurations, operations, etc. referred to in the following. Furthermore, in the figures, components which are the same as or similar to previously appearing components are denoted by the same reference signs or there is a case where once a component is denoted by a reference sign in a figure, it is not denoted in the following figures. In addition, in the following description, once an explanation is given, it is not repeated or it is simplified.

Embodiment 1

Figure 1:
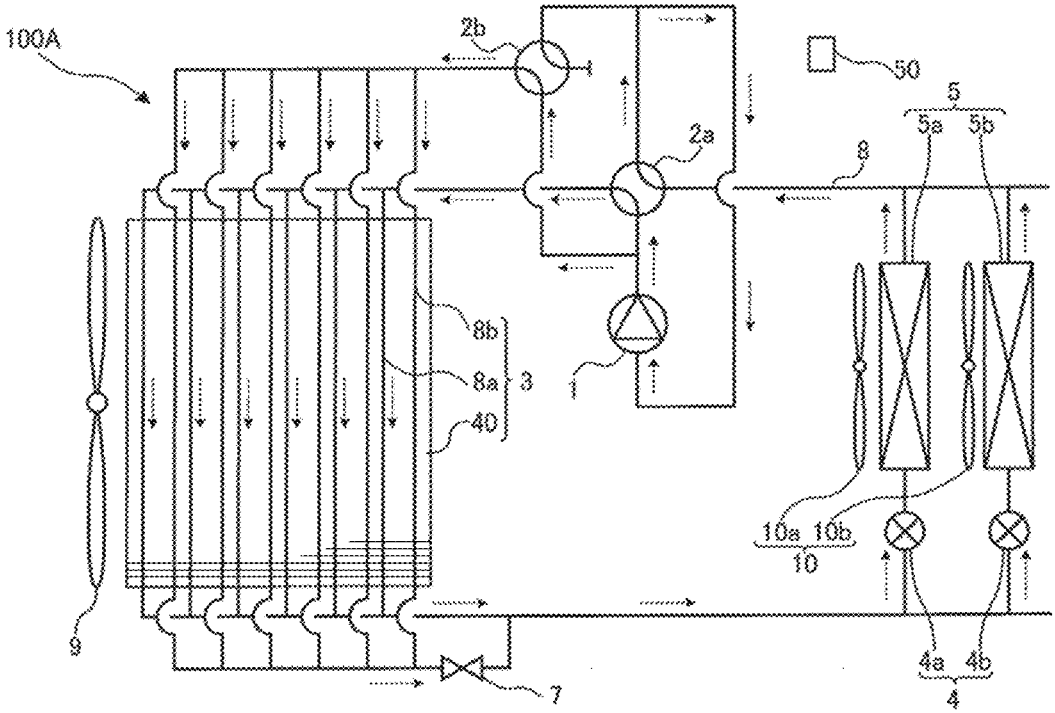
FIG. 1 is a schematic diagram illustrating an example of the configuration of a refrigerant circuit of a refrigeration cycle apparatus according to embodiment 1 of the present invention.

FIG. 1 is a schematic diagram illustrating an example of the configuration of a refrigerant circuit of a refrigeration cycle apparatus (hereinafter referred to as a refrigeration cycle apparatus 100A) according to embodiment 1 of the present invention. It should be noted that in FIG. 1, the flow of refrigerant is indicated by dotted arrows. Furthermore, a controlled opened state of a refrigerant blocking mechanism 7 is represented by an outlined symbol in FIG. 1. High and low values of temperature and pressure, etc., are not determined in relation to absolute values, but are relatively determined based on, for example, a state and an operation of, for example, a system or an apparatus.

<Configuration of Refrigeration Cycle Apparatus 100A>

The refrigeration cycle apparatus 100A is applied as an apparatus provided with a refrigerant circuit, for example, a freezer, a refrigerator or an air-conditioning apparatus.

As illustrated in FIG. 1, the refrigeration cycle apparatus 100A includes a compressor 1, a cooling and heating switching mechanism 2*a*, a high-and-low-pressure switching mechanism 2*b*, an outdoor heat exchanger (first heat exchanger) 3, expansion mechanisms 4, indoor heat exchangers (second heat exchangers) 5 and a refrigerant blocking mechanism 7. The compressor 1, the cooling and heating switching mechanism 2*a*, the high-and-low-pressure switching mechanism 2*b*, the outdoor heat exchanger 3, the expansion mechanisms 4 and the indoor heat exchangers 5 are connected by refrigerant pipes 8, whereby a refrigerant circuit is formed.

FIG. 1 illustrates two indoor heat exchangers 5 arranged in parallel; and one of them is an indoor heat exchanger 5*a*, and the other is an indoor heat exchanger 5*b*. Also, FIG. 1 illustrates the expansion mechanisms 4 connected to the indoor heat exchangers 5 arranged in parallel; and one of the expansion mechanisms 4 is an expansion mechanism 4*a* connected to the indoor heat exchanger 5*a*, and the other is an expansion mechanism 4*b* connected to the indoor heat exchanger 5*b*. In the following description, in the case where the indoor heat exchangers 5*a* and 5*b* do not need to be distinguished from each other, they are each referred to as the indoor heat exchanger 5; and similarly, in the case where the expansion mechanisms 4*a* and 4*b* do not need to be distinguished from each other, they are each referred to as the expansion mechanism 4.

The compressor 1 compresses the refrigerant. The refrigerant compressed by the compressor 1 is discharged, and then sent to the cooling and heating switching mechanism 2*a* and the high-and-low-pressure switching mechanism 2*b*. As the compressor 1, for example, a rotary compressor, a scroll compressor, a screw compressor, or a reciprocating compressor can be applied.

The cooling and heating switching mechanism 2*a* is provided on a discharge side of the compressor 1, and switches the flow direction of refrigerant between the flow direction of refrigerant for a heating operation and that for a cooling operation. To be more specific, in the heating operation, the state of the cooling and heating switching mechanism 2*a* is switched to a state that the cooling and heating switching mechanism 2*a* causes the compressor 1 to communicate with the indoor heat exchangers 5, and in the cooling operation, the state of the cooling and heating switching mechanism 2*a* is switched to a state that the cooling and heating switching mechanism 2*a* causes the compressor 1 to communicate with the outdoor heat exchanger 3. It should be noted that although the configuration of the cooling and heating switching mechanism 2*a* is not limited to a specific one, preferably, a four-way valve as illustrated in, for example, FIG. 1, should be applied as the cooling and heating switching mechanism 2*a*.

The high-and-low-pressure switching mechanism 2*b* is provided in a refrigerant pipe 8 connecting a point between the compressor 1 and the cooling and heating switching mechanism 2*a* to the outdoor heat exchanger 3, and switches the flow direction of the refrigerant in accordance with an operation state. To be more specific, in a given operation state, the state of the high-and-low-pressure switching mechanism 2*b* is switched to a state that the high-and-low-pressure switching mechanism 2*b* causes the discharge side of the compressor 1 to communicate with the second refrigerant passages 8*b* of the outdoor heat exchanger 3, and in another operation state, the state of the high-and-low-pressure switching mechanism 2*b* is switched to a state that the high-and-low-pressure switching mechanism 2*b* causes a suction side of the compressor 1 to communicate with the second refrigerant passages 8*b* of the outdoor heat exchanger 3. Although the configuration of the high-and-low-pressure switching mechanism 2*b* is not limited to a specific one, preferably, a four-way valve as illustrated in, for example, FIG. 1, should be applied as the high-and-low-pressure switching mechanism 2*b*.

The outdoor heat exchanger 3 functions as an evaporator in the heating operation, and functions as a condenser in the cooling operation. The outdoor heat exchanger 3 includes first refrigerant passages 8*a* and the second refrigerant passages 8*b*, which are arranged in parallel in the refrigerant circuit. The first refrigerant passages 8*a* and the second refrigerant passages 8*b* are manufactured as heat transfer tubes of, for example, a fin-and-tube heat exchanger, which share fins 40 with each other. For example, as illustrated in FIG. 1, the outdoor heat exchanger 3 is configured such that heat transfer tubes included in the first refrigerant passages 8*a* and heat transfer tubes included in the second refrigerant passages 8*b* are alternately arranged. Furthermore, the first refrigerant passages 8*a* and the second refrigerant passages 8*b* enable the outdoor heat exchanger 3 to be partially used.

The partial use of the outdoor heat exchanger 3 means that part of the outdoor heat exchanger 3 which contributes to heat exchange is used by making refrigerant flow in a first refrigerant passage or passages 8*a* and a second refrigerant passage or passages 8*b*. In the following description, time in which the outdoor heat exchanger 3 is partially used in the refrigeration cycle apparatus 100A will be referred to as a heat-exchanger partial control time of the refrigeration cycle apparatus 100A.

The expansion mechanism 4 expands the refrigerant having passed through the indoor heat exchanger 5 or the outdoor heat exchanger 3 to reduce the pressure of the refrigerant. Preferably, as the expansion mechanism 4, for example, an electric expansion valve capable of adjusting the flow rate of refrigerant should be applied. In addition to the electric expansion valve, for example, a mechanical expansion valve employing a diaphragm as a pressure receiving part or a capillary tube can be applied as the expansion mechanism 4.

The indoor heat exchanger 5 functions as a condenser in the heating operation, and functions as an evaporator in the cooling operation. As the indoor heat exchanger 5, for example, a fin-and-tube heat exchanger, a microchannel heat exchanger, a shell-and-tube heat exchanger, a heat pipe heat exchanger, a double-pipe heat exchanger, or a plate heat exchanger can be applied. The following description is made by referring to by way of example the case where the indoor heat exchanger 5 is a fin-and-tube heat exchanger.

The refrigerant blocking mechanism 7 is provided at a second refrigerant passage 8*b* to open or close the second refrigerant passage 8*b*. Preferably, as the refrigerant blocking mechanism 7, for example, a shut-off valve or a two-way valve should be applied. The following description is made by referring to by way of example the case where the refrigerant blocking mechanism 7 is a shut-off valve.

The refrigerant pipes 8 connect the components of the refrigeration cycle apparatus 100A. Of the refrigerant pipes 8, refrigerant pipes 8 provided in the outdoor heat exchanger 3 are classified into the first refrigerant passages 8*a* and the second refrigerant passages 8*b*.

The first refrigerant passages 8*a* are each formed to include part of a refrigerant pipe 8 and a heat transfer tube. In the first refrigerant passages 8*a*, the refrigerant flows even at the heat-exchanger partial control time.

The second refrigerant passages 8*b* are each formed to include part of a refrigerant pipe 8 and a heat transfer tube. In the second refrigerant passages 8*b*, the refrigerant does not flow at the heat-exchanger partial control time.

The refrigeration cycle apparatus 100A further includes an outdoor fan 9 and indoor fans 10. The outdoor fan 9 is provided close to the outdoor heat exchanger 3, and supplies air, which is a heat-exchange fluid, to the outdoor heat exchanger 3.

The indoor fans 10 are provided close to the indoor heat exchangers 5, and supplies air, which is a heat-exchange fluid, to the indoor heat exchanger 5.

FIG. 1 illustrates by way of example the case where the indoor fans 10 are provided for the respective indoor heat exchangers 5 arranged in parallel, and illustrates the indoor fan 10 for the indoor heat exchanger 5*a* as an indoor fan 10*a*, and the indoor fan 10 for the indoor heat exchanger 5*b* as an indoor fan 10*b*. In the following description, if the indoor fans 10*a* and 10*b* do not need to be distinguished from each other, they will be each referred to as the indoor fan 10.

Furthermore, the refrigeration cycle apparatus 100A includes a controller 50 which exerts control over the refrigeration cycle apparatus 100A. The controller 50 is electrically connected to various sensors (not illustrated) for, for example, the compressor 1, the cooling and heating switching mechanism 2*a*, the high-and-low-pressure switching mechanism 2*b*, the expansion mechanisms 4, the refrigerant blocking mechanism 7, the outdoor fan 9, and the indoor fans 10.

The controller 50 controls actuators (driving components such as the compressor 1, the cooling and heating switching mechanism 2*a*, the high-and-low-pressure switching mechanism 2*b*, the expansion mechanisms 4, the refrigerant blocking mechanism 7, the outdoor fan 9, and the indoor fans 10) on the basis of detection values of the various sensors. The controller 50 can be made of hardware, such as circuit devices which fulfill functions of the controller, or can be made of an arithmetic device, such as a microcomputer or a central processing unit (CPU), and software which runs on the device.

<Operations of Refrigeration Cycle Apparatus 100A>

Operations of the refrigeration cycle apparatus 100A will be described along with the flow of the refrigerant. First of all, a normal cooling operation of the refrigeration cycle apparatus 100A will be described with reference to FIG. 1. FIG. 1 illustrates the configuration of the refrigerant circuit in the normal cooling operation of the refrigeration cycle apparatus 100A. In the normal cooling operation, the refrigerant flows through both the indoor heat exchangers 5*a* and 5*b*. Thus, in the following description of the normal cooling operation, each of the indoor heat exchangers 5*a* and 5*b* is referred to as the indoor heat exchanger 5. The same is true of the expansion mechanisms 4 and the indoor fans 10.

In the normal cooling operation, the controller 50 switches states of the cooling and heating switching mechanism 2*a* and the high-and-low-pressure switching mechanism 2*b* to states that they cause the discharge side of the compressor 1 and the outdoor heat exchanger 3 to communicate with each other as illustrated in FIG. 1. To be more specific, the state of the cooling and heating switching mechanism 2*a* is switched by the controller 50 to a state that the cooling and heating switching mechanism 2*a* causes the discharge side of the compressor 1 to communicate with the first refrigerant passage 8*a* of the outdoor heat exchanger 3. The state of the high-and-low-pressure switching mechanism 2*b* is switched by the controller 50 to a state that the high-and-low-pressure switching mechanism 2*b* causes the discharge side of the compressor 1 to communicate with the second refrigerant passage 8*b* of the outdoor heat exchanger 3. The refrigerant blocking mechanism 7 is controlled to be in an opened state by the controller 50. A low-pressure-side passage of the high-and-low-pressure switching mechanism 2*b* is closed as illustrated in FIG. 1.

The compressor 1 is driven to discharge high-temperature, high-pressure vapor refrigerant. To be more specific, the high-temperature, high-pressure vapor refrigerant into which the refrigerant is changed in the compressor 1 is divided into two on the discharge side of the compressor 1. Each of the divided high-temperature, high pressure vapor refrigerants passes through the cooling and heating switching mechanism 2*a* or the high-and-low-pressure switching mechanism 2*b*, and flows into the outdoor heat exchanger 3. In the normal cooling operation, the outdoor heat exchanger 3 functions as a condenser. The high-temperature, high-pressure vapor refrigerants transfer heat to outdoor air which is supplied from the outdoor fan 9 to the outdoor heat exchanger 3, and thus condense to change into high-pressure liquid refrigerant.

The high-pressure liquid refrigerant discharged from the outdoor heat exchanger 3 passes through the expansion mechanisms 4, and thus expands to change into low-temperature, low-pressure, two-phase gas-liquid refrigerant. The two-phase gas-liquid refrigerant flows into the indoor heat exchangers 5. In the normal cooling operation, each of the indoor heat exchangers 5 functions as an evaporator. The low-temperature, low-pressure, two-phase gas-liquid refrigerant removes heat from indoor air which is supplied from the indoor fan 10 to the indoor heat exchanger 5, and thus evaporates to change into low-pressure vapor refrigerant. By the heat exchange in the indoor heat exchanger 5, space to be cooled is cooled.

Thereafter, the low-pressure vapor refrigerant passes through the cooling and heating switching mechanism 2*a*, and is sucked into the compressor 1. Then, the refrigerant is circulated in the refrigeration cycle in the same manner as described above.

Figure 2:
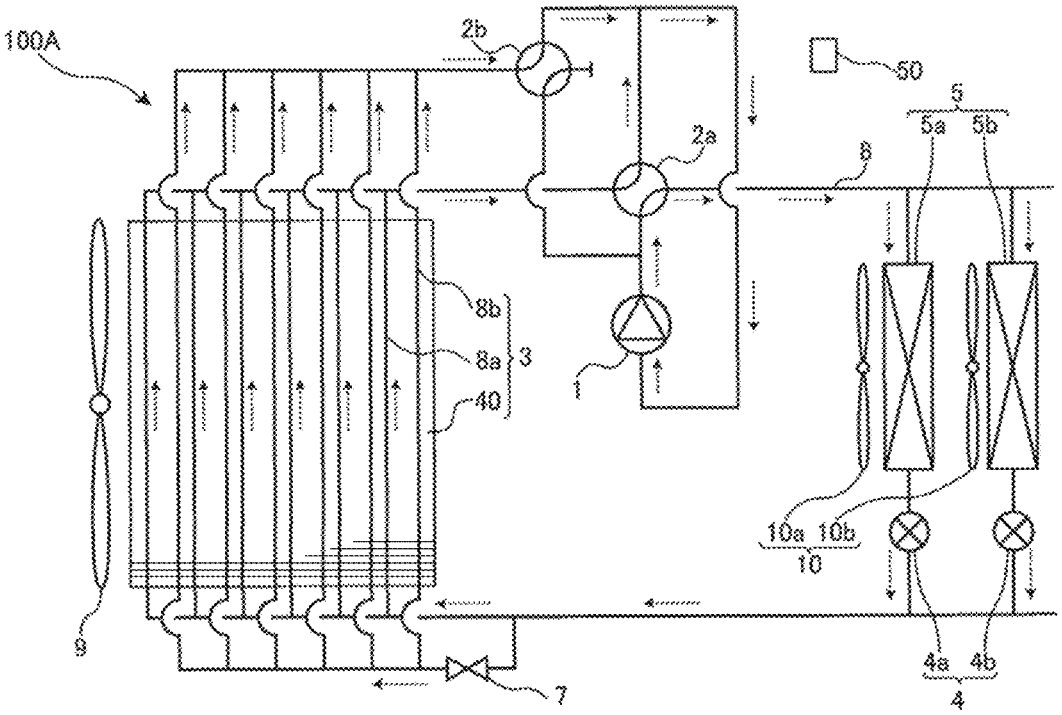
FIG. 2 is a schematic diagram illustrating an example of the configuration of the refrigerant circuit in a heating operation of the refrigeration cycle apparatus according to embodiment 1 of the present invention.

The heating operation of the refrigeration cycle apparatus 100A will be described with reference to FIG. 2. FIG. 2 is a schematic diagram illustrating an example of the configuration of the refrigerant circuit in the heating operation of the refrigeration cycle apparatus 100A. Furthermore, in the heating operation, the refrigerant flows through both the indoor heat exchangers 5*a* and 5*b*. In the following description of the heating operation, these indoor heat exchangers are each referred to as the indoor heat exchanger 5. The same is true of the expansion mechanisms 4 and the indoor fans 10. In FIG. 2, the flow direction of the refrigerant is indicated by dotted arrows. The controlled opened state of the refrigerant blocking mechanism 7 is represented by an outlined symbol in FIG. 2.

In the heating operation, the controller 50 switches the states of the cooling and heating switching mechanism 2*a* and the high-and-low-pressure switching mechanism 2*b* to states that they cause the suction side of the compressor 1 and the outdoor heat exchanger 3 to communicate with each other as illustrated in FIG. 2. To be more specific, the state of the cooling and heating switching mechanism 2*a* is switched by the controller 50 to a state that the cooling and heating switching mechanism 2*a* causes the suction side of the compressor 1 to communicate with the first refrigerant passage 8*a* of the outdoor heat exchanger 3. The state of the high-and-low-pressure switching mechanism 2*b* is switched by the controller 50 to a state that the high-and-low-pressure switching mechanism 2*b* causes the suction side of the compressor 1 to communicate with the second refrigerant passage 8*b* of the outdoor heat exchanger 3. The refrigerant blocking mechanism 7 is controlled to be in the opened state by the controller 50. A high-pressure-side passage of the high-and-low-pressure switching mechanism 2*b* is closed as illustrated in FIG. 2.

The compressor 1 is driven to discharge high-temperature, high-pressure vapor refrigerant. To be more specific, the high-temperature, high-pressure vapor refrigerant into which the refrigerant is changed in the compressor 1 passes through the cooling and heating switching mechanism 2*a*, and flows into the indoor heat exchangers 5. In the heating operation, each of the indoor heat exchangers 5 functions as a condenser. The high-temperature, high-pressure vapor refrigerant transfers heat to indoor air which is supplied from the indoor fan 10 to the indoor heat exchanger 5, and thus condenses to change into high-pressure liquid refrigerant. By the heat exchange in the indoor heat exchanger 5, space to be heated is heated.

The high-pressure liquid refrigerant discharged from the indoor heat exchanger 5 passes through the expansion mechanism 4, and thus expands to change into low-temperature, low-pressure, two-phase gas-liquid refrigerant. The two-phase gas-liquid refrigerant flows into the outdoor heat exchanger 3. In the heating operation, the outdoor heat exchanger 3 functions as an evaporator. The low-temperature, low-pressure, two-phase gas-liquid refrigerant removes heat from the outdoor air which is supplied from the outdoor fan 9 to the outdoor heat exchanger 3, and thus evaporates to change into low-pressure vapor refrigerant.

Thereafter, the low-pressure vapor refrigerant passes through the cooling and heating switching mechanism 2*a* or the high-and-low-pressure switching mechanism 2*b*, and is sucked into the compressor 1. Then, the refrigerant is circulated in the refrigeration cycle in the same manner as described above.

Next, a low-outdoor-air-temperature cooling operation of the refrigeration cycle apparatus 100A will be described. The low-outdoor-air-temperature cooling operation means a cooling operation under a condition that a dry-bulb temperature of outdoor air is lower than an evaporating temperature of the refrigerant in the indoor heat exchangers 5. At a low-outdoor-air-temperature cooling operation time at when the low-outdoor-air-temperature cooling operation is performed, the difference between a condensing temperature of the refrigerant in the outdoor heat exchanger 3 and the temperature of the outdoor air is more easily increased than that in the normal cooling operation, and the condensing capacity of the outdoor heat exchanger 3 tends to be excessively large. Therefore, it is harder to ensure a necessary condensing pressure and a necessary compression ratio for the operation of the apparatus in the refrigeration cycle, particularly the operation of the compressor 1.

In view of the above, in the refrigeration cycle apparatus 100A, the rotation speed of the outdoor fan 9 is reduced to reduce the flow rate of air which passes through the outdoor heat exchanger 3, in the configuration of the refrigerant circuit as illustrated in FIG. 1. Therefore, in the refrigeration cycle apparatus 100A, the condensing capacity can be reduced, thus ensuring a proper condensing pressure and a proper compression ratio in the refrigeration cycle apparatus 100A.

When the rotation speed of the outdoor fan 9 is reduced, the flow rate of air passing through the outdoor heat exchanger 3 more greatly depends on outside wind, and the refrigeration cycle more easily becomes unstable as the outside wind varies. In other words, there is a limit to a control over the capacity of the heat exchanger, which is performed by reducing the rotation speed of the outdoor fan 9. It should be noted that an allowable reduced rotation speed of the outdoor fan 9 which is determined by also taking account of the effect of the outside wind is approximately 10% of a maximum rotation speed.

Even if the rotation speed of the outdoor fan 9 is reduced to the allowable minimum value for the control, and then if a proper condensing pressure and a proper compression ratio cannot be ensured, the refrigeration cycle apparatus 100A performs the heat-exchanger partial control to adjust the capacity of the outdoor heat exchanger 3.

Figure 3:
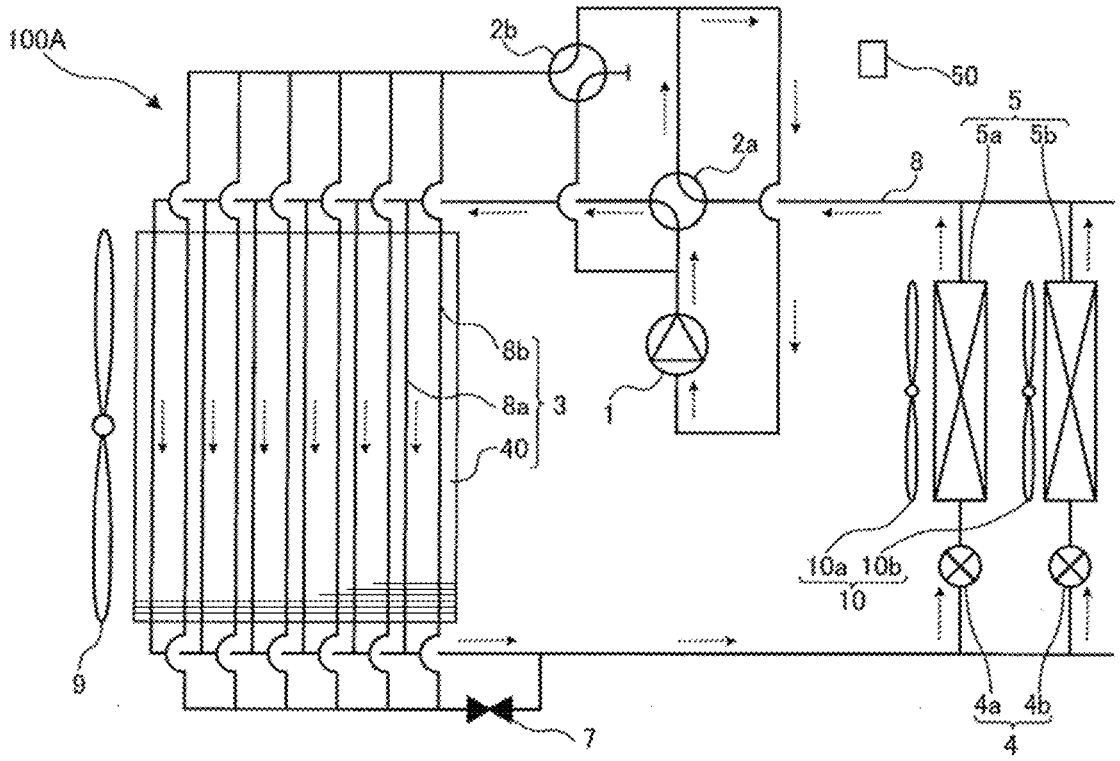
FIG. 3 is a schematic diagram illustrating an example of the configuration of the refrigerant circuit during a heat-exchanger partial control in a low-outdoor-air-temperature cooling operation of the refrigeration cycle apparatus according to embodiment 1 of the present invention.
Figure 4:
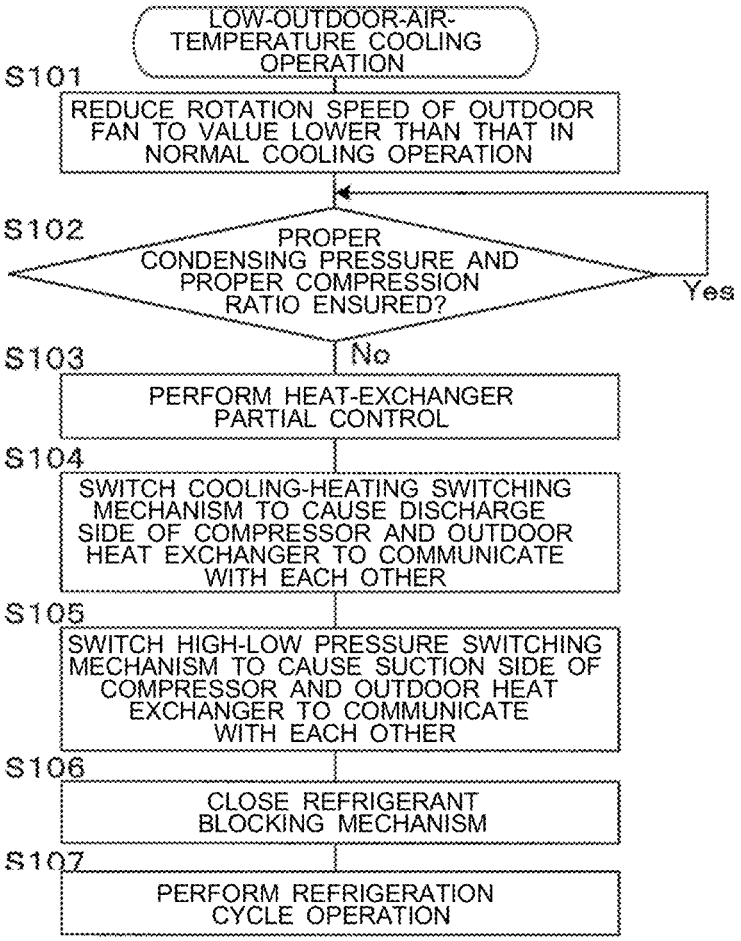
FIG. 4 is a flowchart for explaining the flow of processes in the low-outdoor-air-temperature cooling operation of the refrigeration cycle apparatus according to embodiment 1 of the present invention.

FIG. 3 is a schematic diagram illustrating an example of the configuration of the refrigerant circuit during the heat-exchanger partial control in the low-outdoor-air-temperature cooling operation of the refrigeration cycle apparatus 100A FIG. 4 is a flowchart illustrating processes in the low-outdoor-air-temperature cooling operation of the refrigeration cycle apparatus 100A. The heat-exchanger partial control at the low-outdoor-air-temperature cooling time in the refrigeration cycle apparatus 100A will be described with reference to FIGS. 3 and 4.

In the low-outdoor-air-temperature cooling operation, the refrigerant flows through both the indoor heat exchangers 5*a* and 5*b*. Thus, in the following description, each of these indoor heat exchangers is referred to as the indoor heat exchanger 5. The same is true of the expansion mechanisms 4 and the indoor fans 10. In FIG. 3, the flow direction of the refrigerant is indicated by dotted arrows. A controlled closed state of the refrigerant blocking mechanism 7 is represented by a black symbol in FIG. 3.

In the low-outdoor-air-temperature cooling operation, the controller 50 first causes the refrigerant to circulate as in the normal cooling operation, and reduces the rotation speed of the outdoor fan 9 to a value lower than that in the normal cooling operation (step S101). When the rotation speed of the outdoor fan 9 is reduced, the flow rate of air passing through the outdoor heat exchanger 3 is also reduced. Thereby, the condensing capacity is reduced, thus ensuring a proper condensing pressure and a proper compression ratio. As described above, however, even if the rotation speed of the outdoor fan 9 is reduced to the allowable minimum value, there is a case where the proper condensing pressure and the proper compression ratio cannot be ensured.

In view of the above, the controller 50 determines whether the proper condensing pressure and the proper compression ratio are ensured or not (step S102). The controller 50 determines whether or not the condensing pressure and the compression ratio are proper in accordance with whether the condensing pressure and the compression ratio fall within respective preset threshold ranges or not. When determining that the proper condensing pressure and the proper compression ratio are not ensured (No in step S102), the controller 50 performs the heat-exchanger partial control to adjust the capacity of the outdoor heat exchanger 3 (step S103).

In the low-outdoor-air-temperature cooling operation, as illustrated in FIG. 3, the controller 50 switches the state of the cooling and heating switching mechanism 2*a* to cause to the state that the cooling and heating switching mechanism 2*a* causes the discharge side of the compressor 1 and the outdoor heat exchanger 3 to communicate with each other, and switches the state of the high-and-low-pressure switching mechanism 2*b* to the state that the high-and-low-pressure switching mechanism 2*b* causes the suction side of the compressor 1 and the outdoor heat exchanger 3 to communicate with each other. More specifically, the state of the cooling and heating switching mechanism 2*a* is switched by the controller 50 to the state that the cooling and heating switching mechanism 2*a* causes the discharge side of the compressor 1 to communicate with the first refrigerant passages 8*a* of the outdoor heat exchanger 3 as in the normal cooling operation (step S104). The state of the high-and-low-pressure switching mechanism 2*b* is switched by the controller 50 to the state that the high-and-low-pressure switching mechanism 2*b* causes the suction side of the compressor 1 to communicate with the second refrigerant passages 8*b* of the outdoor heat exchanger 3, with the discharge side of the compressor 1 and the outdoor heat exchanger 3 held caused to communicate with each other by the cooling and heating switching mechanism 2*a* (step S105).

Furthermore, the controller 50 causes the refrigerant blocking mechanism 7 to be closed (step S106). The high-pressure-side passage of the high-and-low-pressure switching mechanism 2*b* is closed as illustrated in FIG. 3. In such a state, the controller 50 causes the refrigerant to circulate in the following manner to perform the low-outdoor-air-temperature cooling operation with the heat-exchanger partial control (step S107).

The compressor 1 is driven to discharge high-temperature, high-pressure vapor refrigerant. To be more specific, the high-temperature, high-pressure vapor refrigerant in which the refrigerant is changed by the compressor 1 passes through the cooling and heating switching mechanism 2*a*, and flows into the outdoor heat exchanger 3. In the low-outdoor-air-temperature cooling operation, the outdoor heat exchanger 3 functions as a condenser. The high-temperature, high-pressure vapor refrigerant transfers heat to outdoor air which is supplied from the outdoor fan 9 to the outdoor heat exchanger 3, and thus condenses to change into high-pressure liquid refrigerant. Since the state of the high-and-low-pressure switching mechanism 2*b* is switched to the state that the high-and-low-pressure switching mechanism 2*b* causes the suction side of the compressor 1 and the second refrigerant passage 8*b* of the outdoor heat exchanger 3 to communicate with each other, the refrigerant flows only through the first refrigerant passages 8*a* of the outdoor heat exchanger 3.

The high-pressure liquid refrigerant discharged from the outdoor heat exchanger 3 passes through the expansion mechanisms 4, and thus the refrigerant expands to change into low-temperature, low-pressure, two-phase gas-liquid refrigerant. The two-phase gas-liquid refrigerant flows into the indoor heat exchangers 5. In the low-outdoor-air-temperature cooling operation, each of the indoor heat exchanger 5 functions as an evaporator. The low-temperature, low-pressure, two-phase gas-liquid refrigerant removes heat from the indoor air which is supplied from the indoor fan 10 to the indoor heat exchanger 5, and thus evaporates to change into low-pressure vapor refrigerant. By the heat exchange in the indoor heat exchanger 5, space to be cooled is cooled.

Thereafter, the low-pressure vapor refrigerant passes through the cooling and heating switching mechanism 2*a*, and is sucked into the compressor 1. Then, the refrigerant is circulated in the refrigeration cycle in the same manner as described above.

When the state of the high-and-low-pressure switching mechanism 2*b* is switched in the above manner, the refrigerant is not allowed to flow through the second refrigerant passages 8*b* of the outdoor heat exchanger 3 in the refrigeration cycle apparatus 100A, and at the same time, the inner pressure of the second refrigerant passage 8*b* is substantially equalized to a suction pressure of the compressor 1. Therefore, if the temperature of outside air is higher than or equal to a saturation temperature based on the pressure of refrigerant sucked into the compressor, it is possible to greatly reduce the amount of refrigerant condensing and staying in the second refrigerant passages 8*b*.

In the refrigeration cycle apparatus 100A, if the outdoor air temperature is less than the saturation temperature based on the pressure of refrigerant sucked into the compressor, the heat of condensation of the refrigerant flowing through the first refrigerant passages 8*a* is transferred to the second refrigerant passages 8*b* by heat conduction through the fins 40. Thus, in the refrigeration cycle apparatus 100A, the temperature of the second refrigerant passages 8*b* can be kept higher than the saturation temperature based on the pressure of refrigerant sucked into the compressor.

Since the temperature of the second refrigerant passages 8*b* can be kept higher than the saturation temperature based on the pressure sucked into the compressor, the refrigerant will not condense or stay in the second refrigerant passages 8*b* even if the shut-off valve, which is provided as the refrigerant blocking mechanism 7, has poor closing performance, and the refrigerant leaks and flows into the second refrigerant passages 8*b*.

In the case where the refrigeration cycle apparatus 100A does not perform the heating operation, it is not necessary to provide the cooling and heating switching mechanism 2*a*, and the shut-off valve, which serves as the refrigerant blocking mechanism 7, can be replaced with a check valve. If it is replaced with a check valve, the manufacturing cost can be reduced.

By virtue of the above operations and the above configuration of the outdoor heat exchanger 3, even if the outdoor air temperature is less than the saturation temperature based on the pressure of refrigerant sucked into the compressor, it is possible to greatly reduce the amount of refrigerant condensing and staying in the second refrigerant passages 8*b*, thus ensuring a proper condensing pressure and a proper compression ratio for the refrigeration cycle.

If the temperature of outside air is lower, there is a case where the amount of heat transferred from the second refrigerant passages 8*b* to the outside air is larger than the amount of heat transferred from the first refrigerant passages 8*a* to the second refrigerant passages 8*b*, and the temperature of the second refrigerant passages 8*b* cannot be kept higher than or equal to the saturation temperature based on the pressure of refrigerant sucked into the compressor. In this case, the refrigerant will condense in the second refrigerant passages 8*b*. However, by providing the refrigerant blocking mechanism 7 at a higher level than the high-and-low-pressure switching mechanism 2*b*, by gravity, liquid refrigerant condensed in the second refrigerant passages 8*b* easily flows through the high-and-low-pressure switching mechanism 2*b* and flows into to the suction side of the compressor 1. By this configuration, it may be possible that staying of condensed refrigerant is prevented, and the proper condensing pressure and the proper compression ratio for the refrigeration cycle are maintained.

It should be noted that in the case where pressure losses in pipes connecting indoor units (not illustrated) and an outdoor unit (not illustrated) in the cooling operation are not taken into consideration, the evaporating temperature of the refrigerant in each indoor heat exchanger 5 is equal to the saturation temperature of the refrigerant sucked into the compressor.

Furthermore, in order to reduce the pressure losses in the refrigerant pipes in the heating operation, it is preferable that the cooling and heating switching mechanism 2*a* and the high-and-low-pressure switching mechanism 2*b* be provided as close as possible to a suction inlet of the compressor 1.

Embodiment 2

Figure 5:
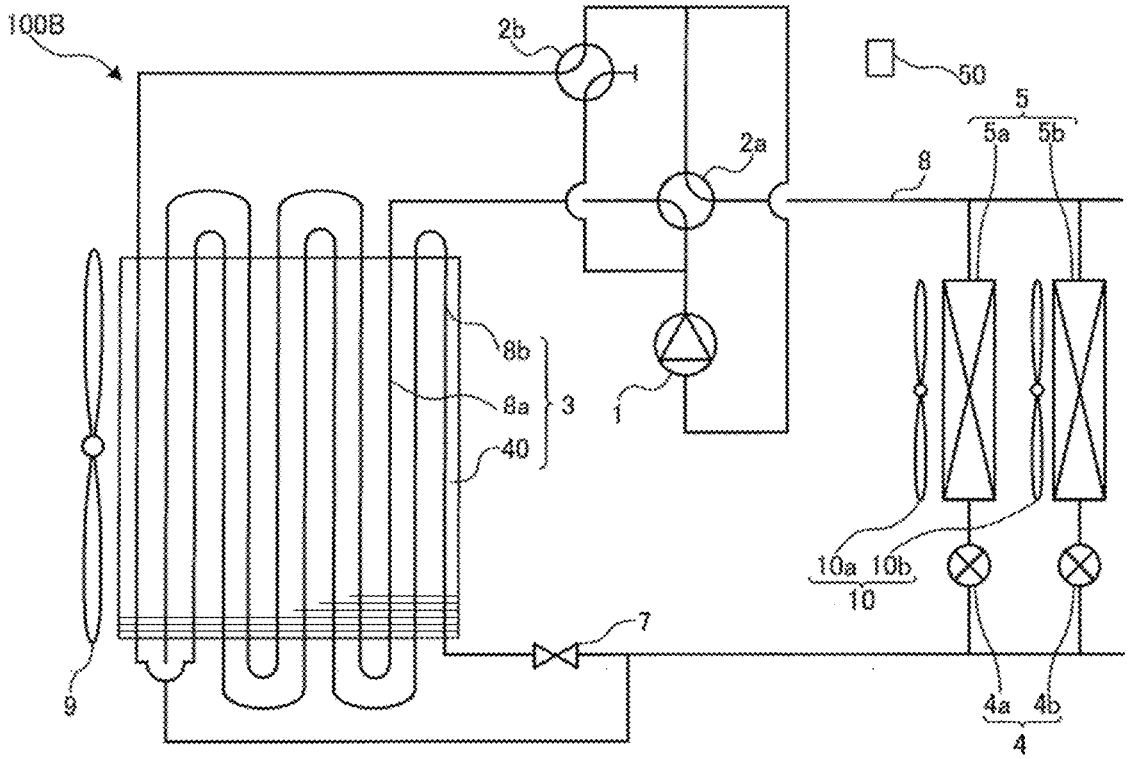
FIG. 5 is a schematic diagram illustrating an example of the configuration of a refrigerant circuit of a refrigeration cycle apparatus according to embodiment 2 of the present invention.

FIG. 5 is a schematic diagram illustrating an example of the configuration of a refrigerant circuit of a refrigeration cycle apparatus (hereinafter referred to as a refrigeration cycle apparatus 100B) according to embodiment 2 of the present invention. The refrigeration cycle apparatus 100B according to embodiment 2 of the present invention will be described with reference to FIG. 5. It should be noted that the second embodiment will be described by referring mainly to part of embodiment 2 which differs from embodiment 1. With respect to embodiment 2, components which are the same as those in embodiment 1 will be denoted by the same reference signs, and their descriptions will be omitted.

The basic configuration and operation of the refrigeration cycle apparatus 100E are the same as or similar to those of the refrigeration cycle apparatus 100A according to embodiment 1, except the following configuration: in the refrigeration cycle apparatus 100A according to embodiment 1, a plurality of first refrigerant passages, i.e., the first refrigerant passages 8*a*, extend in the outdoor heat exchanger 3, and also a plurality of second refrigerant passages, i.e., the second refrigerant passages 8*b*, extend in the outdoor heat exchangers 3. By contrast, in the refrigeration cycle apparatus 100B, a single first refrigerant passage 8*a* extends in the outdoor heat exchanger 3 as a continuous passage, and also a single second refrigerant passage 8*b* extends in the outdoor heat exchanger 3 as a continuous passage.

In the refrigeration cycle apparatus 100B, since each of the first refrigerant passage 8*a* and the second refrigerant passage 8*b* is provided as a continuous passage, the passage length of the outdoor heat exchanger 3 is long. Thus, the function of the outdoor heat exchanger 3 may be lowered due to an increase in the pressure loss in the passage which occurs because of the long passage length of the outdoor heat exchanger 3. However, since the refrigerant is not divided into refrigerants, the refrigerant is not unevenly distributed, as a result of which deterioration of the function of the outdoor heat exchanger 3 does not occur, which would occur if the refrigerant were unevenly distributed.

Embodiment 3

Figure 6:
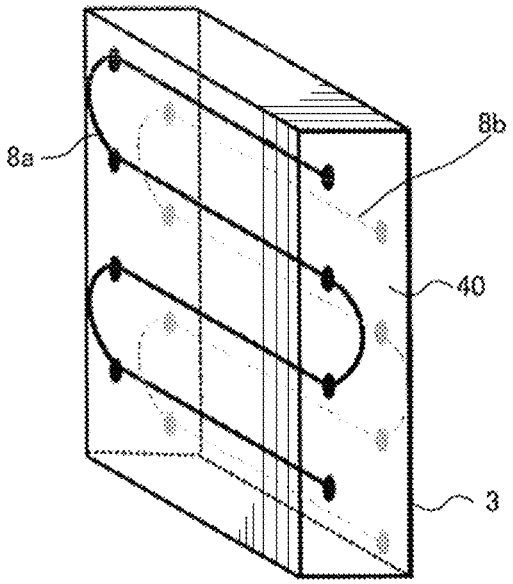
FIG. 6 is a schematic diagram illustrating an example of the configuration of an outdoor heat exchanger included in a refrigeration cycle apparatus according to embodiment 3 of the present invention.

FIG. 6 is a schematic diagram illustrating an example of the configuration of an outdoor heat exchanger 3 included in a refrigeration cycle apparatus according to embodiment 3 of the present invention. The refrigeration cycle apparatus according to embodiment 3 of the present invention will be described with reference to FIG. 6. It should be noted that the third embodiment will be described by referring mainly to part of embodiment 3 which differs from embodiments 1 and 2. With respect to embodiment 3, components which are the same as those in embodiments 1 and 2 will be denoted by the same reference signs, and their descriptions will be omitted.

The basic configuration and operation of the refrigeration cycle apparatus according to embodiment 3 are the same as or similar to those of the refrigeration cycle apparatus 100A according to embodiment 1, except the following configuration: in the refrigeration cycle apparatuses according to embodiments 1 and 2, the first refrigerant passages 8*a* and the second refrigerant passages 8*b* are alternately arranged in the outdoor heat exchanger 3 or the first refrigerant passage 8*a* and the second refrigerant passage 8*b* are alternately arranged in the outdoor heat exchanger 3. By contrast, in the refrigeration cycle apparatus according to embodiment 3, a first refrigerant passage 8*a* and a second refrigerant passage 8*b* share the fins 40 with each other, and are adjacent to each other.

To be more specific, in an outdoor heat exchanger 3 including two or more passages arranged in a row, a first refrigerant passage 8*a* and a second refrigerant passage 8*b* can be provided to share the fins 40 with each other, and arranged adjacent to each other in a row. In view of this point, in the refrigeration cycle apparatus according to embodiment 3, the outdoor heat exchanger 3 is configured such that the first refrigerant passage 8*a* and the second refrigerant passage 8*b* are arranged adjacent to each other in a row as illustrated in FIG. 6. It should be noted that the second refrigerant passage 8*b* need not entirely share the fins 40 with the first refrigerant passage 8*a*, that is, it suffices that part of the second refrigerant passage 8*b* shares the fins 40 with the first refrigerant passage 8*a* such that the length of the part is greater than or equal to half of the length of the entire second refrigerant passage 8*b*.

In the refrigeration cycle apparatus according to embodiment 3, the outdoor heat exchanger 3 is configured such that two or more first refrigerant passages 8*a* and two or more second refrigerant passages 8*b* are arranged adjacent to each other in a row, and share the fins 40 with each other. By virtue of this configuration, the refrigeration cycle apparatus according to embodiment 3 obtains the same advantages as the refrigeration cycle apparatuses according to embodiments 1 and 2.

While embodiments 1 to 3 of the present invention are individually described above, the present invention is not intended to be limited to the configuration, operation, etc., described above with respect to the embodiments, and can be modified as appropriate without departing from the spirit and scope of the present invention. For example, although the embodiments are described above by referring to by way of example a multi-refrigeration cycle apparatus in which two indoor units and a single outdoor unit are connected, the refrigeration cycle apparatus of the invention is not necessarily limited to the multi-refrigeration cycle apparatus. A single-type refrigeration cycle apparatus in which a single indoor unit and a single outdoor unit are connected to each other may be applied. Also, the refrigeration cycle apparatus of the invention may include another shut-off valve, another expansion mechanism, a pressure vessel, such as an accumulator or a receiver, various bypass pipes, or an internal heat exchanger.

Reference Signs List

1 compressor 2*a* cooling and heating switching mechanism 2*b* high-and-low-pressure switching mechanism 3 outdoor heat exchanger 4 expansion mechanism 4*a* expansion mechanism 4*b* expansion mechanism 5 indoor heat exchanger 5*a* indoor heat exchanger 5*b* indoor heat exchanger 7 refrigerant blocking mechanism 8 refrigerant pipe 8*a* first refrigerant passage 8*b* second refrigerant passage 9 outdoor fan 10 indoor fan 10*a* indoor fan 10*b* indoor fan 40 fins 50 controller 100A refrigeration cycle apparatus 100B refrigeration cycle apparatus

The invention claimed is:

1. A refrigeration cycle apparatus comprising a refrigerant circuit in which a compressor, a first heat exchanger, an expansion mechanism and a second heat exchanger are connected by pipes, wherein the first heat exchanger includes a first refrigerant passage and a second refrigerant passage that share a plurality of fins with each other, the first refrigerant passage and the second refrigerant passage are provided in parallel in the refrigerant circuit;

a high-and-low-pressure switching valve is provided on an inlet side of the second refrigerant passage of the first heat exchanger in an operation in which the first heat exchanger functions as a condenser, and the high-and-low-pressure switching valve is configured to perform switching between flow directions of the refrigerant;

a refrigerant blocking valve is provided on an outlet side of the second refrigerant passage of the first heat exchanger in the operation, and the refrigerant blocking valve is configured to block flow of the refrigerant, each of the first refrigerant passage and the second refrigerant passage is divided into a plurality of passages in the first heat exchanger, and the first heat exchanger is configured such that each of the plurality of passages of the first refrigerant passage and each of the plurality of passages of the second refrigerant passage are alternately arranged.

2. The refrigeration cycle apparatus of claim 1, wherein in the operation in which the first heat exchanger functions as the condenser, the refrigerant blocking valve is opened to cause the second refrigerant passage to communicate with a high-pressure side through the high-and-low-pressure switching valve, thereby allowing the refrigerant to flow through the second refrigerant passage.

3. The refrigeration cycle apparatus of claim 2, wherein in the operation in which the first heat exchanger functions as the condenser, when a dry-bulb temperature of air for heat exchange with the refrigerant in the first heat exchanger is lower than an evaporating temperature of the refrigerant in the second heat exchanger, the refrigerant blocking valve is closed to cause the second refrigerant passage to communicate with a low-pressure side through the high-and-low-pressure switching valve, thereby blocking flowing of the refrigerant into the second refrigerant passage.

4. The refrigeration cycle apparatus of claim 1, wherein the first heat exchanger includes two or more first refrigerant passages including the first refrigerant passage and two or more second refrigerant passages including the second refrigerant passage, and the two or more first refrigerant passages and the two or more second refrigerant passages are arranged adjacent to each other in a row.

5. The refrigeration cycle apparatus of claim 1, further comprising an outdoor fan configured to send air to the first heat exchanger, wherein in a case where the flowing of the refrigerant into the second refrigerant passage is blocked, a rotation speed of the outdoor fan is lower than in a case where the refrigerant flows through the second refrigerant passage.

6. The refrigeration cycle apparatus of claim 1, wherein in the second refrigerant passage, the refrigerant blocking valve is located higher than the high-and-low-pressure switching valve with respect to a direction of gravity.

7. The refrigeration cycle apparatus of claim 1, wherein the refrigerant blocking valve is a shut-off valve or a check valve.

8. A refrigeration cycle apparatus comprising a refrigerant circuit in which a compressor, a first heat exchanger, an expansion mechanism and a second heat exchanger are connected by pipes, wherein the first heat exchanger includes a first refrigerant passage and a second refrigerant passage that share a plurality of fins with each other, the first refrigerant passage and the second refrigerant passage are provided in parallel in the refrigerant circuit;

a high-and-low-pressure switching valve is provided on an inlet side of the second refrigerant passage of the first heat exchanger in an operation in which the first heat exchanger functions as a condenser, and the high-and-low-pressure switching valve is configured to perform switching between flow directions of the refrigerant;

a refrigerant blocking valve is provided on an outlet side of the second refrigerant passage of the first heat exchanger in the operation, and the refrigerant blocking valve is configured to block flow of the refrigerant, and each of the first refrigerant passage and the second refrigerant passage includes passage portions, which extend in a row direction and which are located in respective row regions, and in each of the row regions, a respective one of the passage portions of the first refrigerant passage and a respective one of the passage portions of the second refrigerant passage are located close to each other.

9. A refrigeration cycle apparatus comprising a refrigerant circuit in which a compressor, a first heat exchanger, an expansion mechanism and a second heat exchanger are connected by pipes, wherein the first heat exchanger includes a first refrigerant passage and a second refrigerant passage that share a plurality of fins with each other, the first refrigerant passage and the second refrigerant passage are provided in parallel in the refrigerant circuit;

a high-and-low-pressure switching valve is provided on an inlet side of the second refrigerant passage of the first heat exchanger in an operation in which the first heat exchanger functions as a condenser, and the high-and-low-pressure switching valve is configured to perform switching between flow directions of the refrigerant;

a refrigerant blocking valve is provided on an outlet side of the second refrigerant passage of the first heat exchanger in the operation, and the refrigerant blocking valve is configured to block flow of the refrigerant, and in the second refrigerant passage, the refrigerant blocking valve is located higher than the high-and-low-pressure switching valve with respect to a direction of gravity.

10. The refrigeration cycle apparatus of claim 1, wherein the first heat exchanger includes two or more passages arranged in a row, and the first refrigerant passage and the second refrigerant passage are adjacent to each other in the row.

* * * * *